US006839538B1

(12) United States Patent
Gonzalez et al.

(10) Patent No.: US 6,839,538 B1
(45) Date of Patent: Jan. 4, 2005

(54) FUSER ROLLER FOR AN IMAGE FORMING DEVICE

(75) Inventors: Ernie Gonzalez, Boise, ID (US); Jennifer Baker, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/638,214

(22) Filed: Aug. 7, 2003

(51) Int. Cl.[7] ..... G03G 15/20

(52) U.S. Cl. ..... 399/331; 219/216; 219/243; 399/328

(58) Field of Search ..... 399/328–331, 399/333; 219/216, 243, 469, 470, 255; 492/27, 28, 46; 118/60; 347/156

(56) References Cited

U.S. PATENT DOCUMENTS 4,107,830 A 8/1978 Thomson
4,567,349 A * 1/1986 Henry et al. ..... 219/216
5,124,755 A * 6/1992 Hediger ..... 399/329
5,467,178 A * 11/1995 Mui et al. ..... 399/328
5,689,788 A 11/1997 Moser
5,728,252 A * 3/1998 Kniazzeh ..... 492/27 X
5,737,679 A * 4/1998 Uehara et al. ..... 399/329
5,854,465 A * 12/1998 Kishi et al. ..... 219/216
6,035,174 A * 3/2000 Ito et al. ..... 399/328
2003/0063931 A1 * 4/2003 Sanpei et al. ..... 399/328

FOREIGN PATENT DOCUMENTS

JP 2001-312176 * 11/2001

* cited by examiner

*Primary Examiner*—Sophia S. Chen
(74) *Attorney, Agent, or Firm*—Robert D. Wasson

(57) ABSTRACT

A fuser is disclosed that includes a pair of outer rollers with one or more inner rollers displaced within at least one of the outer rollers. Each inner roller may optionally have a convex outer surface.

24 Claims, 5 Drawing Sheets

FUSER ROLLER FOR AN IMAGE FORMING DEVICE

BACKGROUND

In electrophotographic image forming devices, such as laser printers, toner particles are used to form a desired image on print media. The print media is often paper, although a wide variety of different print media may be employed. Once the toner is applied to the media, the media is advanced along a media path to a fuser. In some image forming devices the fuser includes a fuser roller and a mating pressure roller. As the media passes between the fuser roller and the pressure roller, the toner is fused to the media through a process using heat and pressure.

Pursuant to many applications, it is desirable to maintain a substantially uniform pressure in the interference area between the fuser roller and the pressure roller. This interference area is often referred to as the nip. In applications where the axial length of the pressure roller is short, such as is used for printing on narrow media, the pressure roller is relatively rigid and does not deflect substantially when the force of the fuser roller is applied. Longer pressure rollers, however, do tend to deflect substantially when the force of the fuser roller is applied. Likewise, the fuser roller may also deflect under the force from the pressure roller. When deflected, the pressure roller takes a somewhat bowed shape, which may result in uneven pressure at the nip. This uneven, or non-uniform, pressure may result in degraded print quality, wrinkled print media, or other undesirable consequences.

Hence, a system and method for addressing these and other problems is needed.

BRIEF DESCRIPTION OF THE DRAWINGS

The example embodiments of the present invention can be understood with reference to the following drawings. The components in the drawings are not necessarily to scale. Also, in the drawings, like reference numerals designate corresponding parts throughout the several views.

DETAILED DESCRIPTION

Figure 1:
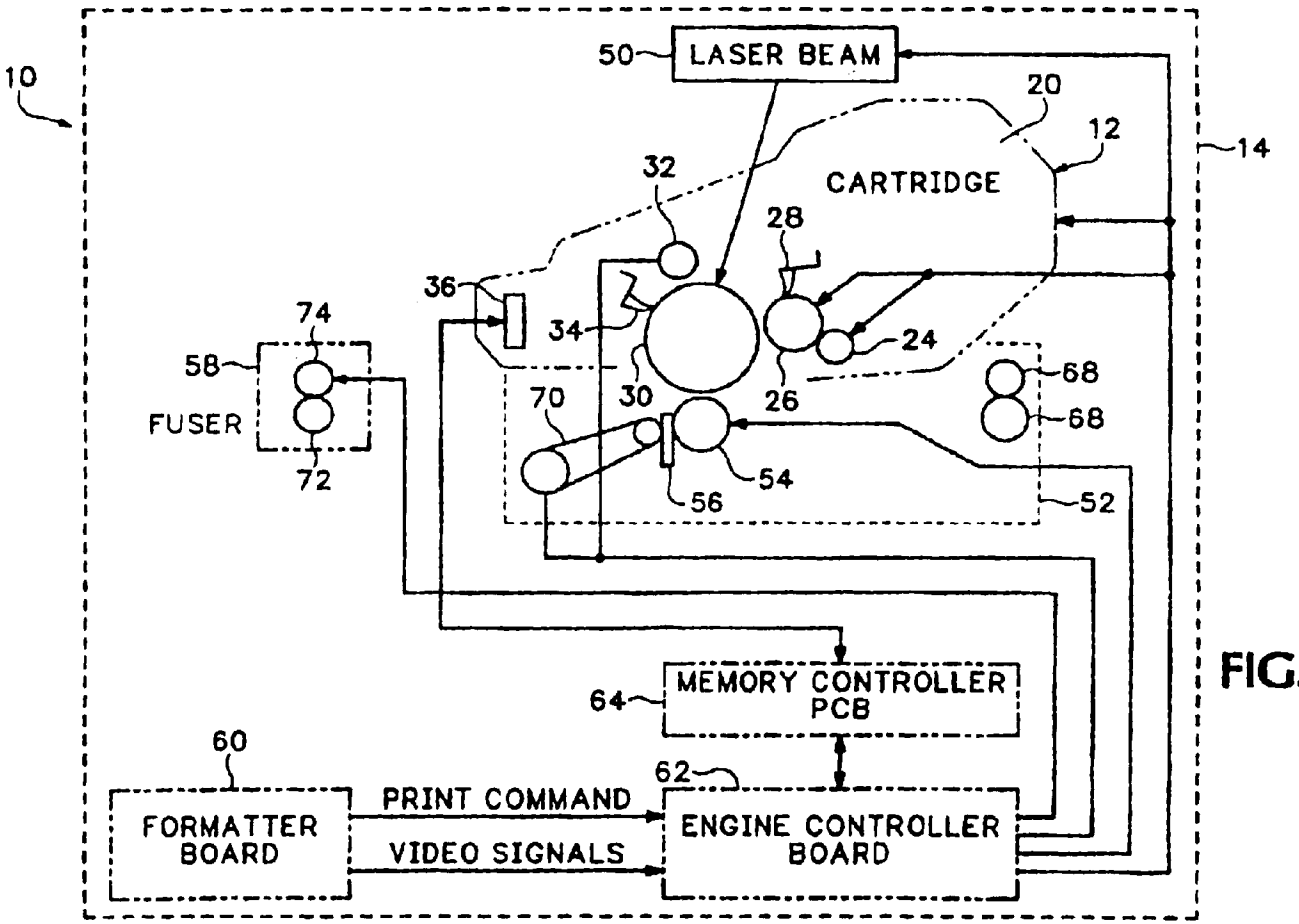
FIG. 1 is a schematic diagram of an image forming device according to an example embodiment.

FIG. 1 schematically illustrates an example embodiment of an image forming system or device 10, which generally includes a cartridge 12 and a main assembly 14. As an example, the device 10 may comprise a laser printer, copier, multifunction device, or the like. The cartridge 12 generally supplies toner for forming images. In the particular embodiment illustrated, the cartridge 12 additionally includes components for transferring toner to a print media, such as paper 88 (e.g., FIG. 2). The cartridge 12 generally includes supply hopper 20, supply roller 24, developer roller 26, blade 28, photosensitive drum 30, charging roller 32, cleaner blade 34, and memory 36.

Supply hopper 20 delivers toner to developer roller 26. Although the cartridge 12 is illustrated as including such components as developer roller 26, blade 28, photosensitive drum 30, charging roller 32 and cleaner blade 34, these components may be omitted in alternative embodiments. For example, in some applications, main assembly 14 may include photosensitive drum 30 in lieu of photosensitive drum 30 being provided as part of cartridge 12. Also, as another example, in some applications, the supply roller 24 may be omitted.

The developer roller 26 supplies toner to photosensitive drum 30. Blade 28 removes excess toner from developer roller 26. In the particular embodiment illustrated, the roller 26 and blade 28 are electrically charged so as to apply charge to the toner. With such charging, the toner attains a negative charge. The charged particles upon developer roller 26 are then transferred to an electrically charged photosensitive drum 30.

Charging roller 32 applies a generally uniform negative charge on the surface of drum 30 which is generally rotatably driven in a clockwise direction as seen in FIG. 1. Prior to receiving toner from developer roller 26, light, such as a laser beam, is projected upon the surface of the drum to discharge the negative potential along the surface of the photosensitive drum where the light strikes the surface. As a result, a latent electrostatic image is created on drum 30.

Once the latent electrostatic image is formed on drum 30, the charged particles from developer roller 26 are transferred to drum 30 in the form of the visible image. This visible image is then transferred to paper or other suitable medium. Excess or residue toner on the surface of drum 30 is removed by blade 34.

Main assembly 14 is generally configured to cooperate with cartridge 12 so as to form an image upon a medium such as paper. Main assembly 14 generally includes image writing system 50, media transport 52, transfer charging roller 54, static charge eliminator 56, fuser 58, and a controller generally including formatter board 60, engine controller board 62, and memory controller 64. Image writer 50 is generally configured to apply light or other waves to photosensitive drum 30, such as in the form of a laser, to write a latent electrostatic image upon the surface of drum 30.

Media transport 52 is conventionally known and generally comprises that portion of main assembly 14 which is configured to supply and transport a medium, such as paper, upon which an image is to be formed. In the particular embodiment illustrated, media transport 52 includes various rollers 68 and a belt 70 configured to transport media from a media supply (not shown) between photosensitive drum 30 and transfer charging roller 54 and further to fuser 58. Various other media transfer mechanisms may be employed in lieu of the one schematically shown.

Transfer charging roller 54 facilitates the transfer of toner from drum 30 to the media in a conventionally known manner. Thereafter, static charge upon the media is removed by static charge eliminator 56 in a conventionally known manner. Once the toner has been transferred to the media, media transport 52 transfers the media to fuser 58.

Fuser 58 is configured to fuse the toner to the media to form a permanent image on the media. In the particular embodiment illustrated, fuser 58 fuses the media with heat and pressure. Fuser 58 generally includes a pressure roller 72 and a fuser roller 74, which are mounted within the device 10, such as by bearings mounted on opposite ends thereof. The fuser roller 74 may also be referred to as a fuser film roller. After the image has been permanently fused to the media by fuser 58, the media is expelled by main assembly 14. Additional details regarding specific embodiments of the fuser 58 are described below.

The controller including formatter board 60, engine controller board 62 and memory controller 64 generally controls the operation of the remainder of cartridge 12 and main assembly 14. In particular, formatter board 60 sends a print signal to the engine controller board 62. In response, the engine controller board 62 drives a main motor (not shown) to rotate photosensitive drum 30, charging roller 32, developing roller 26, various belts and rollers of media transport 52, transfer charging roller and the pressure roller, amongst others. In response to signals from the engine controller board based upon the video signals, image writing system 50 modulates laser beams to create a latent image on the photosensitive drum.

Figure 2:
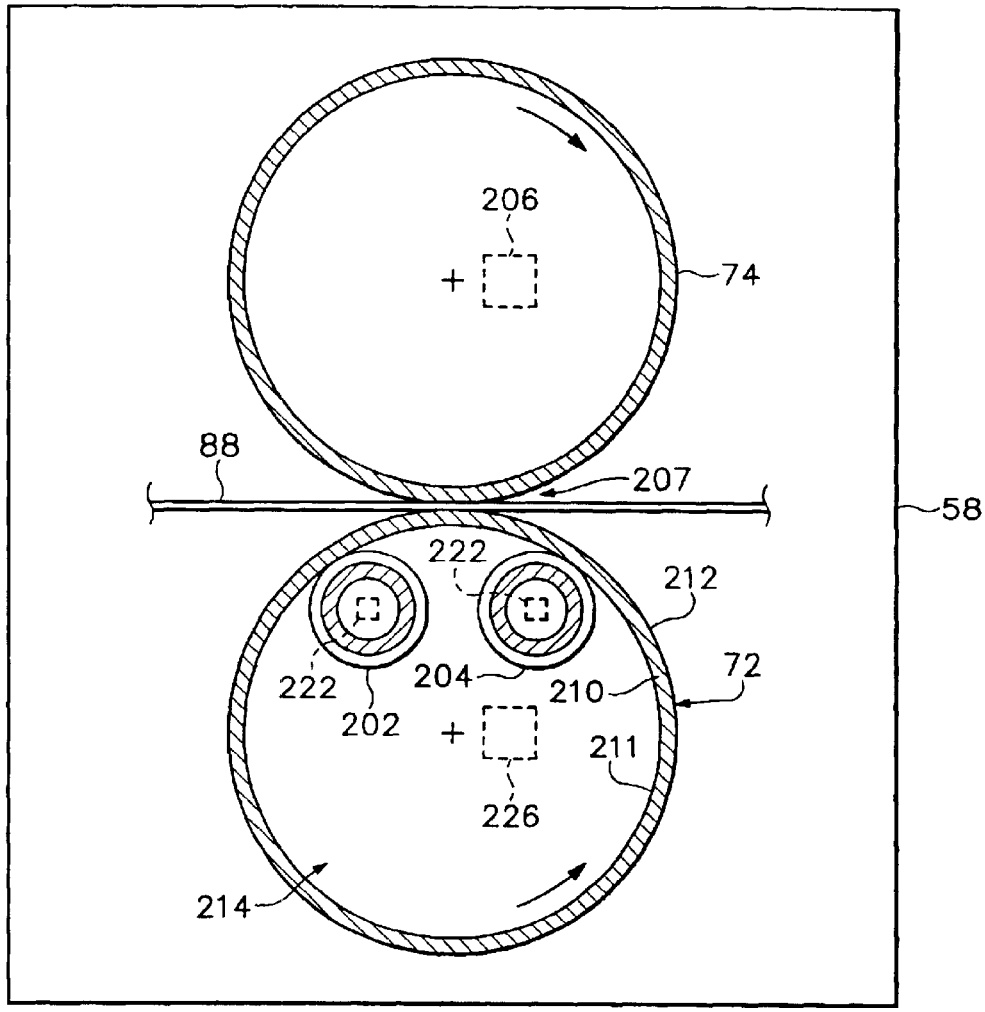
FIG. 2 illustrates details of an example embodiment of the fuser shown in FIG. 1.

FIG. 2 illustrates details of an example embodiment of the fuser 58 (FIG. 1). As shown, the fuser 58 includes the pressure roller 72 and the fuser roller 74. A sheet of media 88 having toner (not shown) thereon is interposed between the rollers 72, 74. As the media 88 passes through rollers 72, 74, the toner is fused to the media by heat and pressure.

The heat may be generated at either or both of the rollers 72, 74. For example, and as shown in FIG. 2, an optional heating element 206 may be positioned inside the fuser roller 74. The beating element 206 may be of the type typically used in conventional fusers. For example, the heating element 206 may be a flash heating element, a ceramic heating element, a halogen bulb heating element, or other suitable heating element. Further, as discussed below, one or more heating elements may alternatively or additionally be disposed within the pressure roller 72. The heating element 206 is, therefore, optional.

The pressure for fusing the toner to the media 88 is generally created by opposing forces generated by the rollers 72, 74 pushing on the media 88 in substantially opposite directions. In FIG. 2, the roller 72 exerts an upward force and the roller 74 exerts an downward force. It is desirable, in many applications, for this pressure to be substantially uniform along the axial length of the rollers 72, 74.

In general, the roller 72 is in pressure contact with the roller 74 when media 88 is not present. The rollers 72, 74 are typically mounted on bearings (not shown) that are biased so that the rollers 72, 74 are pressed against each other under sufficient pressure to form nip 207. It is in the nip 207 that the fusing, or fixing, action typically occurs.

The pressure roller 72 is shown as having a substantially cylindrical wall, or sleeve, 210 that includes an inner surface 211 and an outer surface 212. The inner surface 211 of the pressure roller 72 defines a cavity 214. In an example embodiment, the outer wall 210 may be formed of aluminum and may have a rubber coating (not shown) disposed on the outer surface 212.

Inner rollers 202 and 204 are positioned inside the pressure roller 72. As shown, the inner rollers 202, 204 are positioned in the cavity 214 and are substantially aligned with the pressure roller 72 such that the axes of rotation of the rollers 72, 74, 202, 204 are substantially parallel. The inner rollers 202, 204 may be in rolling contact with the inner surface 211 of the pressure roller 72 such that the inner rollers 202, 204 are rotated by the rotation of the pressure roller 72. In another embodiment, the inner rollers 202 and 204 only contact the inner surface 211 of the pressure roller 72 when the pressure roller is at least partially loaded.

According to some embodiments, a lubricant may be disposed between the inner surface 211 and the inner rollers 202, 204 to improve smooth rolling contact between the inner rollers 202, 204 and the inner surface 211. In one embodiment, lubricant may be disposed on the inner surface 211. In another embodiment, lubricant may be disposed on the inner rollers 202, 204.

In the embodiment shown in FIG. 2, the inner rollers 202, 204 are positioned substantially equidistant from nip 207 and support the wall 210 to limit substantial deformation of the outer wall 210 by the forces applied thereto by the fuser roller 74. The forces applied to the roller 72 by the roller 74 may be transferred via the media 88 when the media 88 is present. Thus, the inner rollers 202, 204 provide support to the portion of the wall 210 opposite the nip to prevent substantial deformation of the wall 210 at the nip. The inner rollers 202, 204 may be mounted within the device 10 (FIG. 1) by bearings or other suitable mechanism.

In one embodiment, the inner rollers 202, 204 are mounted on bearings (not shown) that are biased so that the inner rollers are pressed against the inner surface 211 of the roller 72. The inner rollers 202, 204 may be useful in maintaining the vertical and horizontal positioning, as well as the biasing, of the outer wall 210 of the roller 72.

An optional heating element 222 may be positioned in either or both of the inner rollers 202, 204. An optional heating element 226 may be positioned within the cavity 214 of the roller 72, but outside the inner rollers 202, 204.

The inner rollers 202, 204, in the illustrated embodiment, each have a convex outer surface. Hence, the diameter of each of the inner rollers 202, 204 is greater at a central, or middle, region than at opposing end regions disposed on opposite sides of the central region (see, e.g., FIG. 5). In this configuration, the inner rollers 202, 204 may apply pressure at a central, or middle, region of the roller 72 to reduce deflection of the roller 72 at a central region thereof. In this manner, the inner rollers 202, 204 may be useful in improving the uniformity of pressure in the nip along the axial length of the roller 72. Further, the inner rollers 202, 204 maybe useful in creating a substantially straight fusing surface by reducing deflection of the roller 72 at a central region thereof.

Accordingly, the example embodiment of FIG. 2 may provide for improved uniformity in pressure and heat distribution over the axial length of the roller 72, the roller 74, or both. In embodiments where the inner rollers 202, 204 are convex, the inner rollers apply pressure at the middle region of the roller 72 to offset deflection of the roller 72 at the nip 207. In some applications, the inner rollers 202, 204 are useful in increasing the uniformity of the pressure at the nip 207 as well as improving the straightness of the fusing surface. Hence, fusing of wider media may be accomplished using longer rollers 72, 74, while providing satisfactory pressure uniformity and uniformity of mass per unit length. These factors may result in satisfactory or improved print quality, particularly in applications configured to perform fusing on wide print media.

Figure 3:
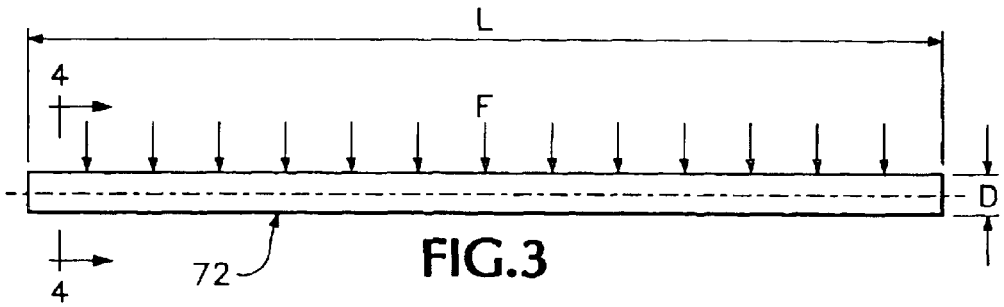
FIG. 3 is a side elevation view of an example embodiment of the pressure roller shown as part of the fuser in FIG. 1.

FIG. 3 shows an embodiment of the roller 72. As shown, the roller 72 has an axial length L and a diameter D. When a fusing force F is applied to the roller 72 by the roller 74, the roller 72 will have a tendency to bow, or buckle in a direction away from the side of the roller 72 to which the fusing force is applied by the roller 74, in the absence of the inner rollers 202, 204 (FIG. 2). This tendency to bow or buckle increases as the axial length L of the roller 72 increases.

For large format toner fuser applications in which wide print media is fused, the length L of the roller 72 is typically long enough that, absent the rollers 202, 204, the fusing force will cause substantial deflection of the roller 72. The length of the roller 72 may vary and, in one example embodiment, may be about 18 inches (about 0.45 meter) or longer. In another embodiment, the length of the roller 72 may be about 48 inches (about 1.2 meters). In other embodiments, the length of the roller 72 is in the range of about 18 inches to about 48 inches. As will be appreciated by those skilled in the art, the roller 72, the roller 74, or both, in some embodiments, may be slightly crowned.

Figure 4:
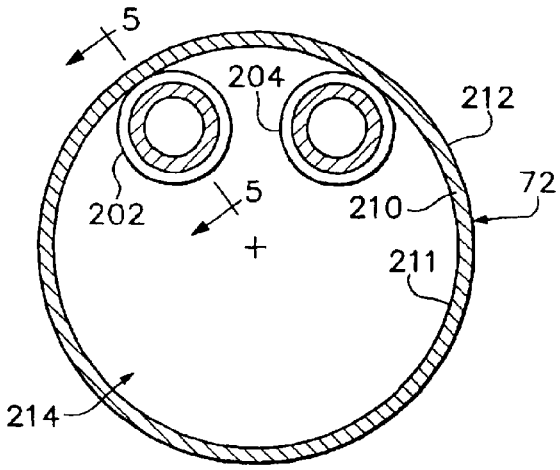
FIG. 4 is a cross-sectional view of the FIG. 3 pressure roller taken along the line 4—4 according to an example embodiment.

FIG. 4 illustrates a cross-section of the roller 72 of FIG. 3 taken along the lines 44. Similar to the embodiment shown in FIG. 2, the roller 72 of FIG. 2 includes inner rollers 202, 204.

Figure 5:
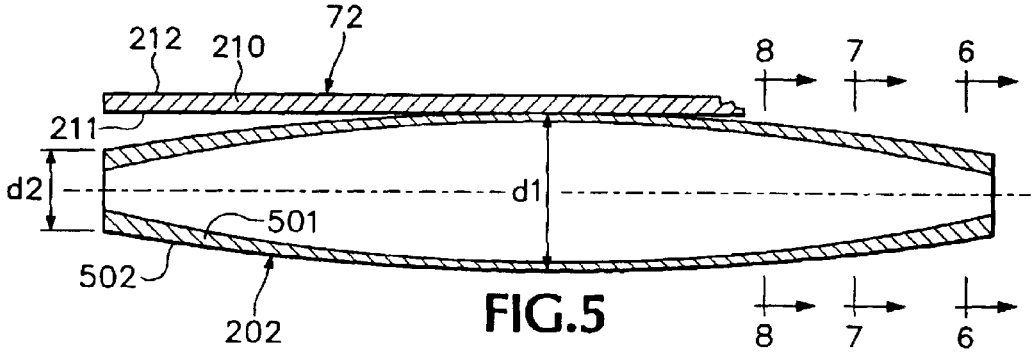
FIG. 5 is a cross-sectional view of one embodiment of a FIG. 4 inner roller, according to an example embodiment.

FIG. 5 illustrates a cross-sectional view of a portion of the roller 72 and the inner roller 202 taken along the lines 5—5 of FIG. 4 according to an example embodiment. The inner roller 202 is shown as being disposed inside the roller 72 and within cavity 214. The inner roller 202 may be formed of any of a variety of materials, including aluminum, steel, carbon fiber, or other suitable material.

As shown in FIG. 5, the roller 72 is not loaded and, thus, neither the wall 210 of the roller 72 nor the inner roller 202 is substantially deflected. In this non-loaded configuration, the inner roller 202 comprises a wall 501 having an external surface 502 that is substantially convex. The external surface 502 of the inner roller 202 in this configuration thus has a diameter d1 at a center thereof and a diameter d2 at an end thereof. In an example embodiment, the diameter d2 is about 10–30% smaller than the diameter d1 in the substantially unloaded configuration of FIG. 5.

The inner roller 202, according to some embodiments, has substantially uniform mass per unit length. Hence, as shown in FIG. 5, the wall 501 has variable thickness. In a central region of the inner roller 202, the wall 501 is thinner than the wall thickness closer to the ends thereof, since the diameter of external surface 502 is greater at the central region of the inner roller 202 than at the ends thereof. In general, moving from the central region toward an end of the inner roller 202, the thickness of the wall 501 gradually increases and the diameter of the external surface 502 decreases. Accordingly, in this configuration, a substantially uniform mass per unit length is maintained, thus facilitating uniform heating of the inner roller 202.

As shown in FIG. 5, the external surface 502 of the inner roller 202 contacts the inner surface 211 of the roller 72. In this configuration, as the roller 72 rotates, the frictional contact between the external surface 502 of the inner roller 202 and the inner surface 211 of the roller 72 causes the inner roller 202 to rotate in a same direction as the roller 72. In other embodiments, the surface 502 of the inner roller 202 may not contact the inner surface 211 of the roller 72 when the roller 72 is not loaded, but contacts the inner surface 211 of the roller 72 when the roller 72 is loaded. The more the wall 210 deflects, the more contact there be between the surface 502 of inner roller 202 and the surface 211 of the roller 72. In some embodiments, the roller 204 is be configured identical to the roller 202.

Figure 6:
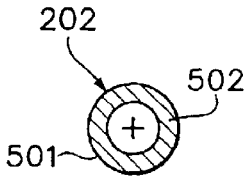
FIG. 6 is a cross-sectional view of the FIG. 5 inner roller taken along the line 6—6 according to an example embodiment.
Figure 7:
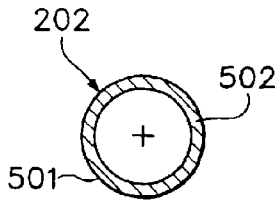
FIG. 7 is a cross-sectional view of the FIG. 5 inner roller taken along the line 7—7 according to an example embodiment.
Figure 8:
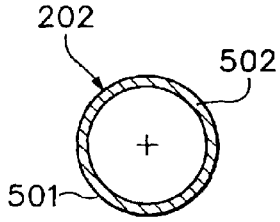
FIG. 8 is a cross-sectional view of the FIG. 5 inner roller taken along the line 8—8 according to an example embodiment.

FIGS. 6, 7, and 8 illustrate cross-sectional views of the inner roller 202 of FIG. 5 taken along lines 6—6, 7—7, and 8—8, respectively. As can be seen, at each of these cross-sections, there is a substantially equal mass. In FIG. 6, a smaller diameter cross-section is shown with a greater wall thickness. In FIG. 7, a larger diameter cross-section is shown with a smaller wall thickness. In FIG. 8, a still larger diameter cross-section is shown with a still smaller wall thickness. Hence, as discussed above, the inner roller 202 has substantially uniform mass per unit length despite having a convex external surface 502 with varying diameter. This is accomplished, at least in part, by having a variable thickness of wall 501. The thickness of the wall 501 generally increases from a minimum at the center of the inner roller 202 to a maximum at the ends of the inner roller 202.

Figure 9:
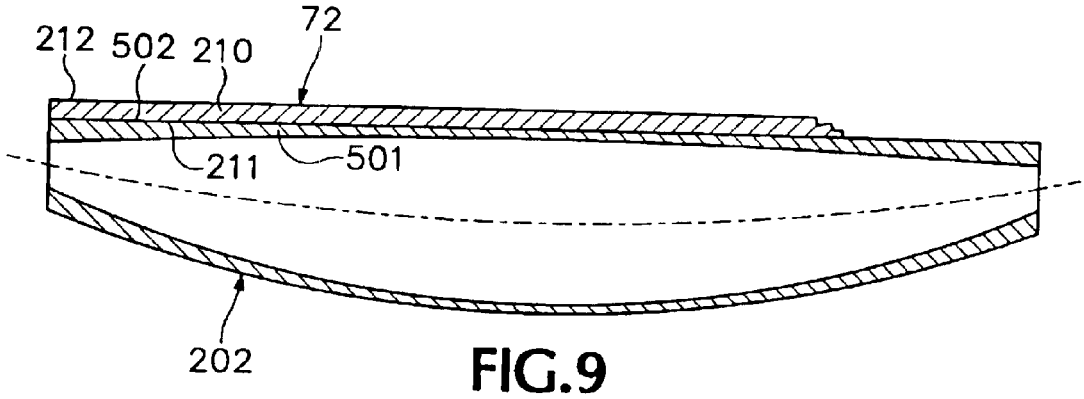
FIG. 9 is a cross-sectional, exaggerated, view of the FIG. 4 inner roller in a fully-loaded configuration, according to an example embodiment.

FIG. 9 illustrates an exaggerated view of the inner roller in a loaded configuration. As shown, the wall 210 is in a loaded configuration and deflects slightly against the inner roller 202. This deflection of the wall 210 deflects the portion of the wall 501 of the inner roller 202 in contact with the inner surface 211 of the roller 202. As the load on the wall 210 increases, the wall 210 deflects and causes corresponding deflection in the wall 510 of the inner roller 202. The extent to which the inner roller 202 is deflected may depend upon several factors, which may, for example, include: the load on the roller 72; the materials used in the roller 72 and in the inner roller 202; the length of the rollers 72, 202; the number and size of the of the inner rollers; the diameter and wall thickness of the roller 72, as well as other factors that will be appreciated by those skilled in the art.

Figure 10:
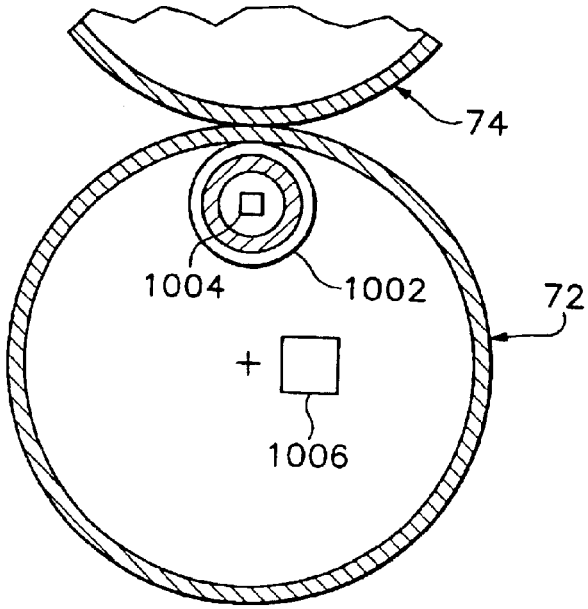
FIG. 10 is a cross-sectional view of a roller in accordance with an example embodiment.

FIG. 10 illustrates an alternate embodiment of roller 72. In this embodiment, the roller 72 includes a single inner roller 1002. The single inner roller 1002 may be configured identical to the inner roller 202 as shown in FIG. 5 and described above. The single inner roller 1002 is shown as being positioned adjacent the nip between the rollers 72, 74. Further, the single inner roller may be positioned such that the axis of rotation of the rollers 72, 74 are substantially collinear with the axis of rotation of the single inner roller 1002. The single inner roller 1002 may optionally have a heating element 1004 disposed therein. Likewise, in the embodiment of FIG. 10, the roller 72 may optionally have a heating element 1006 disposed therein.

Figure 11:
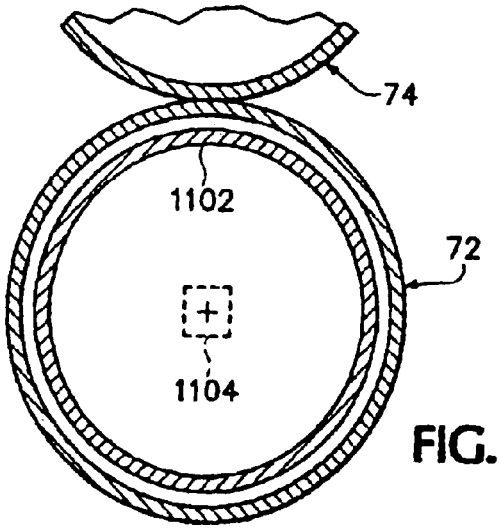
FIG. 11 is a cross-sectional view of a roller in accordance with an example embodiment.

FIG. 11 illustrates another alternate embodiment of roller 72. In this embodiment, inner roller 1102 is positioned inside the roller 72 such that the inner roller 1102 is substantially coaxial with the roller 72. That is, the axis of rotation of the roller 72 is substantially collinear with the axis of rotation of the inner roller 1102. The shape and configuration of the inner roller 1102 is otherwise identical to that of the inner roller 202 shown in FIG. 5 and described above. In this embodiment, however, the maximum outer diameter of the convex inner roller 1102 is approximately equal to the inner diameter of the roller 72. An optional heating element 1104 may be disposed within the inner roller 1102.

Figure 12:
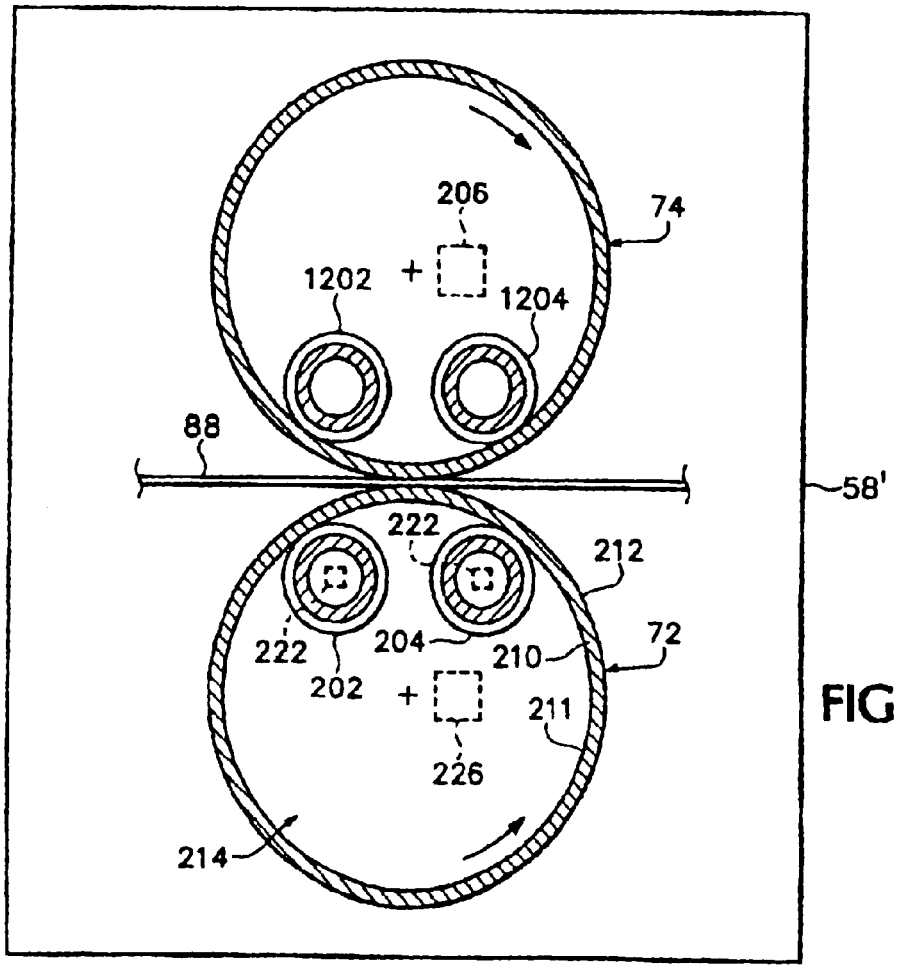
FIG. 12 is a cross-sectional view of a fuser in accordance with an example embodiment.

FIG. 12 illustrates an alternate embodiment in which both the rollers 72, 74 include at least one inner roller. As shown in this embodiment, each of the rollers 72, 74 include two inner rollers. However, in an alternate embodiment (not shown), the rollers 72, 74 may each include a single inner roller positioned in a manner similar to that of roller 1004 in FIG. 10. In the embodiment of FIG. 12, a fuser 58' is shown as having rollers 72, 74. The roller 72 is identical to that shown in FIG. 2 and described above and has inner rollers 202, 204 disposed therein. The roller 74 is identical to that shown in FIG. 2, except that the roller 74 of FIG. 12 includes inner rollers 1202, 1204 disposed inside the roller 74. In one embodiment, the inner rollers 1202 and 202 are vertically aligned. Similarly, the inner rollers 1204 and 204 may be vertically aligned. The inner rollers 1202, 1204 may be configured identical to the inner rollers 202, 204 as described above and shown in the drawings. By providing at least one inner roller in each of the rollers 72, 74 deflection of the rollers 72, 74 may be controlled and improved uniformity in nip pressure may be obtained, in some applications.

Lubricant may optionally be disposed between an inner roller and an inner surface of an outer roller to facilitate smooth rolling contact between the inner roller and the outer roller in the various embodiments described above.

While embodiments of the present invention have been particularly shown and described, those skilled in the art will understand that many variations may be made therein without departing from the scope of the invention as defined in the following claims. The foregoing example embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A fuser for an image forming device, the fuser comprising:

a fuser roller;

a pressure roller adjacent the fuser roller and having a cavity therein;

a first inner roller positioned within the cavity of the pressure roller, the first inner roller having a convex outer surface;

a second inner roller positioned within the cavity of the pressure roller, the second inner roller having a convex outer surface;

the fuser roller, the pressure roller, and the first and second inner rollers each having an axis of rotation, wherein the axes of rotation of the fuser roller, the pressure roller, the first and second inner rollers are parallel.

2. A fuser for an image forming device, the fuser comprising:

a fuser roller;

a pressure roller adjacent the fuser roller and having a cavity therein;

a first inner roller positioned within the cavity of the pressure roller, the first inner roller contacts an inner surface of the pressure roller, wherein the first inner roller comprises an outer wall, the outer wall having a substantially constant mass per unit length.

3. The fuser for an image forming device according to claim 2, wherein the first inner roller has a convex outer surface.

4. The fuser for an image forming device according to claim 2, further comprising a second inner roller positioned within a cavity of the fuser roller.

5. The fuser for an image forming device according to claim 2, further comprising a second inner roller positioned within a cavity of the fuser roller, wherein the second inner roller has a convex outer surface.

6. The fuser for an image forming device according to claim 2, wherein the first inner roller comprises an outer wall, the outer wall having a variable thickness.

7. The fuser for an image forming device according to claim 2, wherein the first inner roller comprises an outer wall, the outer wall being thinner in a central region and thicker in outer regions, the outer regions being on opposite sides of the central region.

8. The fuser for an image forming device according to claim 2, further comprising a heating element disposed within the fuser roller and external to the first inner roller.

9. The fuser for an image forming device according to claim 2, wherein the first inner roller has a larger diameter at a central region thereof than at the ends thereof.

10. A fuser for an image forming device, the fuser comprising:

a fuser roller;

a pressure roller adjacent the fuser roller and having a cavity therein;

a first inner roller positioned within the cavity of the pressure roller, the first inner roller contacts an inner surface of the pressure roller, further comprising a heating element disposed inside the first inner roller.

11. A fuser for an image forming device, the fuser comprising:

an outer roller;

first and second inner rollers disposed inside the outer roller, the first and second inner rollers each having a convex outer surface.

12. The fuser for an image forming device according to claim 11, wherein the first and second inner rollers contact the outer roller.

13. The fuser for an image forming device according to claim 11, wherein the inner rollers each have a diameter on the ends thereof that is less than a diameter at the center thereof.

14. The fuser for an image forming device according to claim 11, further comprising a heating element disposed inside at least one of the first and second inner rollers.

15. A fuser comprising:

a first roller having a substantially cylindrical wall;

a second roller;

a rotatable member inside the first roller, the rotatable member having a convex external surface, wherein the rotatable member has an outer wall, the outer wall having a substantially constant mass per unit length.

16. The fuser according to claim 15, wherein a central region of the convex external surface contacts the cylindrical wall and end regions of the convex external surface of the rotatable member do not contact the cylindrical wall.

17. The fuser according to claim 15, wherein the rotatable member has an outer wall, the outer wall having variable thickness.

18. The fuser according to claim 15, wherein the rotatable member has an outer wall, the outer wall being thinner at a central region than at end regions on opposite sides of the central region.

19. An image forming device, comprising:

a fuser having first and second rollers configured to fuse toner to print media as the print media passes between the first and second rollers;

an inner roller disposed within the first roller, the inner roller having a convex external surface along an axial length of the inner roller, further comprising a heating element disposed in the inner roller.

20. The image forming device of claim 19, wherein the inner roller has an axis of rotation that is coaxial with an axis of rotation of the first roller.

21. The image forming device of claim 19, wherein the inner roller as an axis of rotation distinct from and in spaced relation to the axis of rotation of the first roller.

22. The image forming device of claim 19, wherein the inner roller comprises an external wall, the external wall having a thickness that varies along the axial length of the inner roller.

23. The image forming device of claim 19, further comprising multiple inner rollers disposed within the first roller, individual inner rollers having a convex external surface along an axial length thereof.

24. The image forming device of claim 19, wherein the axes of rotation of the first and second rollers and the axis of rotation of the inner roller are substantially collinear.

* * * * *